United States Patent [19]

LeBron et al.

[11] Patent Number: 4,506,775

[45] Date of Patent: Mar. 26, 1985

[54] NEWSPAPER VENDING MACHINE

[76] Inventors: Melanie C. LeBron; Renard L. LeBron, both of 8008 Harney, Omaha, Nebr. 68114

[21] Appl. No.: 389,014

[22] Filed: Jun. 16, 1982

[51] Int. Cl.[3] ..... G07F 11/16

[52] U.S. Cl. ..... 194/26; 221/18; 221/213

[58] Field of Search ..... 221/14, 17, 18, 19, 221/213, 214, 215, 216, 259, 260; 194/26

[56] References Cited

U.S. PATENT DOCUMENTS

| | | | |
|---|---|---|---|
| 444,502 | 1/1891 | Mossler | 194/26 |
| 535,787 | 3/1895 | Burnett | 194/26 |
| 1,263,669 | 4/1918 | Hoberg | 221/259 X |
| 1,309,173 | 7/1919 | Baker | 221/259 X |
| 1,345,855 | 7/1920 | Hotaling | 221/18 |
| 1,637,710 | 8/1927 | Rider | 221/213 X |
| 2,504,990 | 4/1950 | Leschin | 221/213 X |

FOREIGN PATENT DOCUMENTS

| | | | |
|---|---|---|---|
| 563231 | 9/1958 | Canada | 221/259 |
| 701381 | 12/1953 | United Kingdom | 221/213 |

*Primary Examiner*—F. J. Bartuska
*Attorney, Agent, or Firm*—Glenn K. Robbins

[57] ABSTRACT

A newspaper vending machine. The machine has a housing receiving a stack of newspapers which are secured and protected within the housing and which are dispensed consecutively in a secured manner without opening the machine. An operating handle is rotated and by linkage causes a newspaper gripping and feeding member to pivot in a cyclical and repetitious manner forwardly in a newspaper gripping and feeding operation and rearwardly in a retracting movement for consecutive vending operations. A gripping and feeding member is employed comprising a stiff toothed newspaper engaging element which can flex somewhat while engaging a newspaper adjacent the centerfold and slide it as a unit in the direction of the side fold. A lock comprised of a cam connected to a handle shaft is provided to lock the handle and feeding mechanism against operation until freed by operation of conventional coin acceptor mechanism. A sold out lock is further provided actuated by the weight and exhaustion of the newspapers to lock the operating mechanism when the newspapers have been sold out.

4 Claims, 14 Drawing Figures

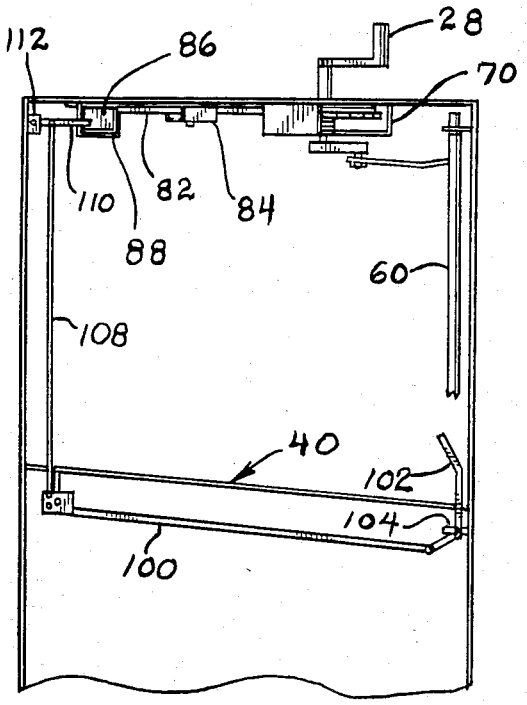
FIG. 5
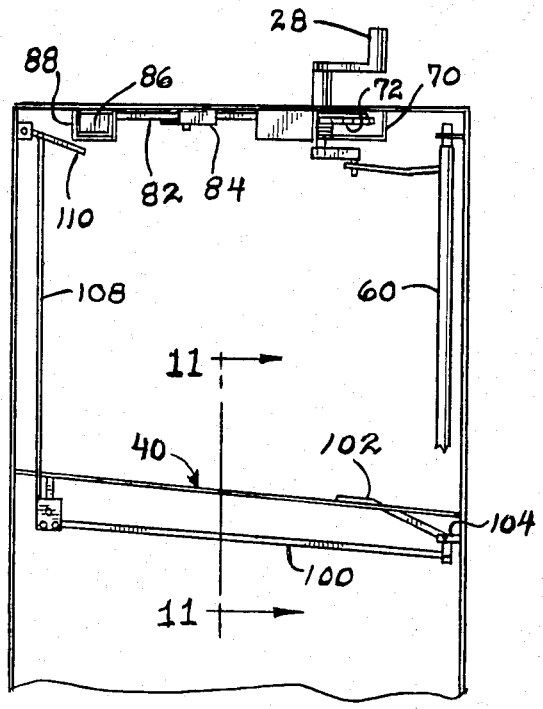
FIG. 6
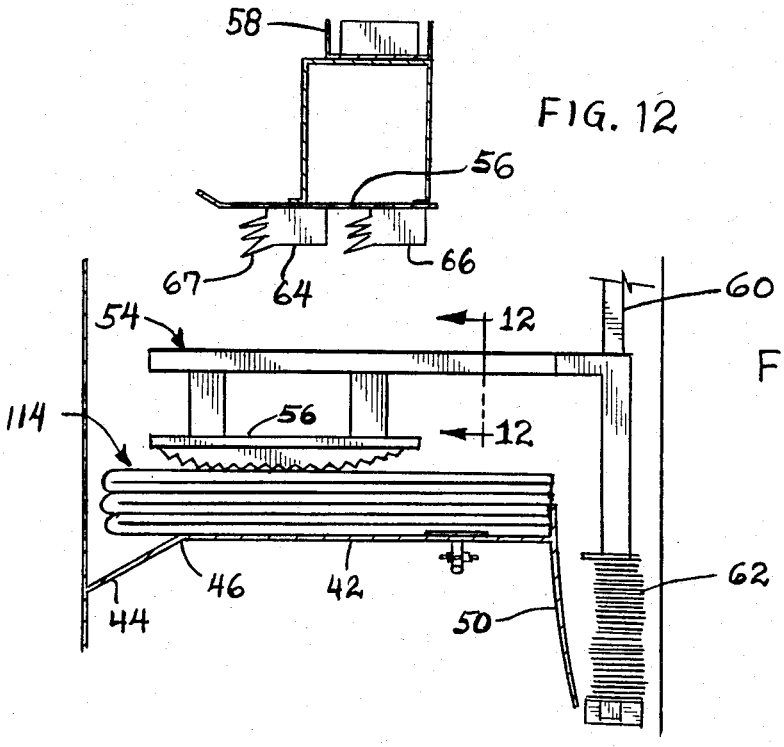
FIG. 12
FIG. 11

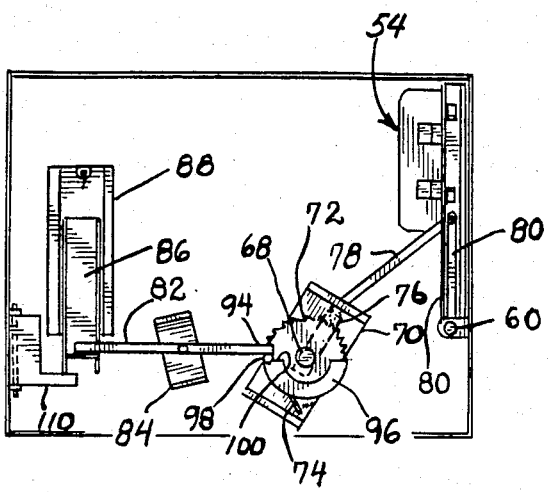
FIG. 7
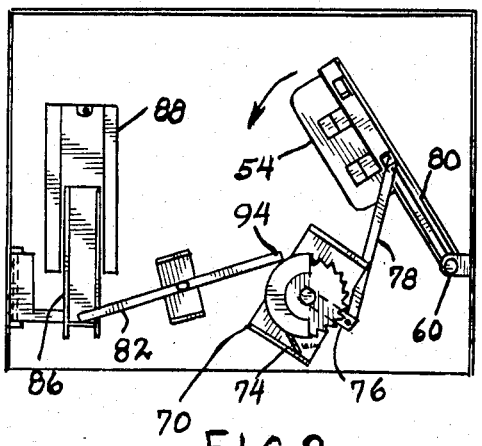
FIG. 8
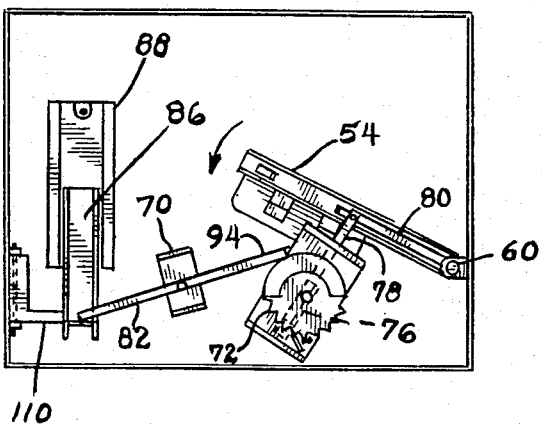
FIG. 9
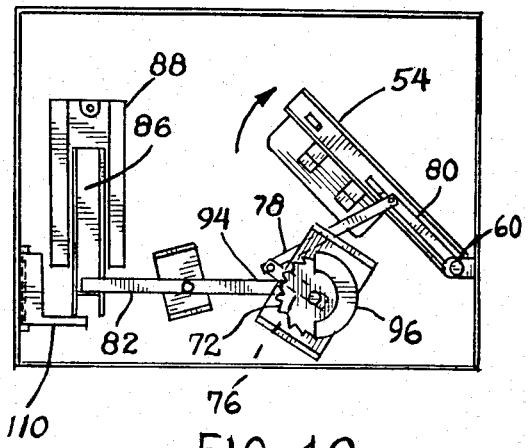
FIG. 10
FIG. 13
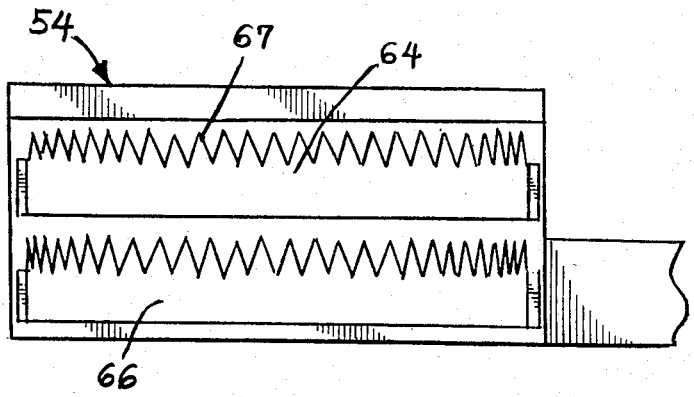

NEWSPAPER VENDING MACHINE

BACKGROUND OF THE INVENTION

In the past various types of vending machines have been employed for vending newspapers and the like at street corners, busy shopping centers and other areas wherever the need justified such a machine. Such vending machines of the coin operated type conventionally are locked and upon the insertion of a coin deactivate the lock to permit the opening of a door enabling the user to withdraw a newspaper from a loaded stack within the machine.

While such machines are in wide use problems have arisen with regard to theft since the entire stack of newspaper is exposed and the user may take one or more newspapers which leaves the machine vulnerable to dishonest users. Further problems are apparent in the required opening and closing of the door after each vending use which contributes to wear and tear on the door latching mechanism and ultimate breakdown depending on the degree of use. Exposure of the inside of the housing to the elements upon opening and closing of the vending door is another disadvantage and it is apparent that the repeated opening and closing with attendant problems has created various disadvantages in the use of such machines. Because of the size and bulk of such newspapers the vending in a secured vending machine has presented severe difficulties.

SUMMARY OF THE INVENTION

By means of this invention there has been provided a newspaper vending machine which has a secured housing which need not be opened on each vending operation and can be operated to dispense a single newspaper upon the acceptance of the necessary coin or other activating mechanism. The machine is handle operated in a simple and efficient manner to effect the vending operation after the coin acceptance mechanism is activated.

The vending machine although primarily designed for newspapers may be used for other publications such as magazines or the like. The housing of the machine provides a safe and durable means for the storage of a stack of the newspapers which is not exposed in any manner to the elements in the vending operation as the machine is closed at all times in the vending operation and is opened only to recharge the machine with a new stack of newspapers or remove an old stack.

The newspaper feeding mechanism is operated by a rotary handle which through a pitman type linkage moves a newspaper gripping and feeding member engaging the top newspaper in a stack through an arc-like forwarding feeding cycle to move the top newspaper off the stack and to a delivery chute and access slot in a protected area of the machine where the newspaper can be grasped by the purchaser and withdrawn. Further operations of the handle retracts the gripping and feeding member across the surface of the next newspaper to the start position for the next vending cycle.

The gripping and feeding member is provided with a serrated or toothed element which is specially adapted to rest lightly on the top surface of the newspaper and engage it with a minimum of penetration. In the retract cycle across the top of the next exposed newspaper no gripping or feeding is effected. Thus the gripping and feeding action is unidirectional. The gripping and feeding mechanism is spring biased and gravity operated in such a fashion that the gripping and feeding member moves downwardly upon the stack of newspapers as it is deplenished.

The handle operation is effected by a handle operated ratchet wheel connected to a pitman type linkage which cycles an operating rod which supports the gripping and feeding member forward in an arc-like movement in the feeding operation and backward in a retracting movement for each full revolution of the operating handle. Thus the handle is simply moved in a 360° cycle to complete each vending operation.

In order to lock the operating handle until the proper coin has been accepted a handle locking mechanism has been provided. This is comprised of a cam plate connected to the ratchet wheel which engages one end of a pivotable locking link. The other end of the locking link engages a coin acceptor operator member which in turn is adapted to be locked and unlocked by a conventional coin acceptor mechanism forming no part of this invention. Upon the activation of the coin acceptor mechanism the coin acceptor operator handle is unlocked which frees the locking link from locking engagement with the cam plate permitting the handle to be operated in the newspaper vending operation.

The device is also provided with a sold out mechanism to prevent operation of the machine when the supply of newspapers has been exhausted. This is effected by a linkage system comprising a pivotable biased member underlying the newspapers. Upon exhaustion of the newspaper supply movement of the member moves and through the linkage system causes the engagement by a sold out stop with the coin acceptor operator to prevent its movement and lock the handle of the vending machine.

The newspaper vending machine of this invention is rugged in design and simple in its operation and maintainance. The simplicity and efficiency in operation has made possible an improved vending machine which can deliver newspapers from a secured housing while completely protecting the newspapers in all phases of operation.

The above features are objects of this invention. Further objects will appear in the detailed description which follows and will be further apparent to those skilled in the art.

For the purpose of illustration of this invention preferred embodiments therof are shown in the accompanying drawing. It is to be understood that the drawing is for purpose of description only and that the invention is not limited thereto.

IN THE DRAWING

FIG. 5 is a view in front elevation of the upper part of the machine with the door open and showing the sold out mechanism activated;

FIG. 6 is a view similar to FIG. 5 showing the sold out mechanism deactivated;

FIG. 7 is a top plan view with the top cover removed showing the operating mechanism at the start position;

FIG. 8 is a view similar to FIG. 7 showing the operating mechanism in the first stage operation;

FIG. 9 is a view similar to FIG. 7 showing the second stage operation;

Figure 14:
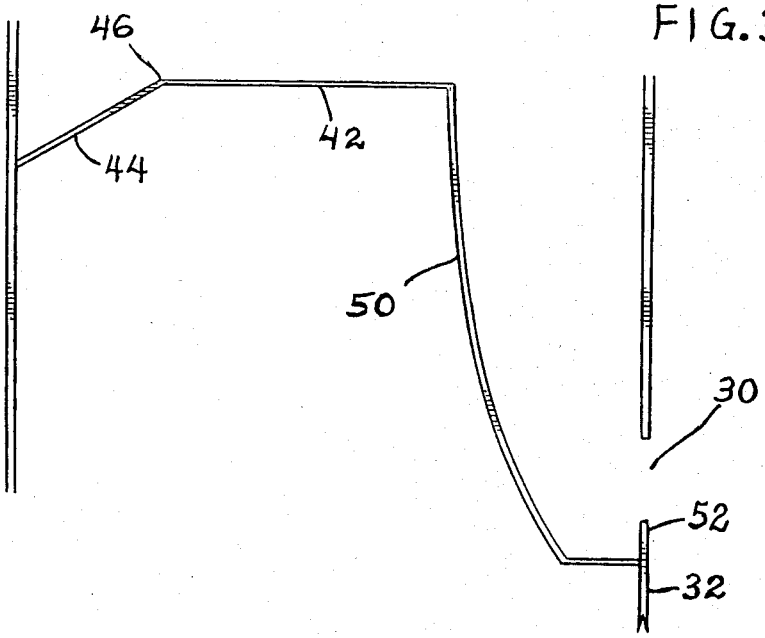

FIG. 10 ia a view similar to FIG. 7 showing the third stage operation;

FIG. 11 is a view in section taken on the line 11—11 of FIG. 6;

FIG. 12 is a view in section taken on the line 12—12 of FIG. 11;

FIG. 13 is an enlarged bottom plan view of the toothed newspaper engaging device; and FIG. 14 is an enlarged fragmentary view in vertical section of the lower part of the machine showing the newspaper stacking shelf and delivery chute.

DESCRIPTION OF THE INVENTION

The newspaper vending machine of this invention is generally depicted by the reference numeral 20 in FIGS. 1 through 4. It is comprised of a housing 22 having a front door 24 for the insertion or removal of a stack of newspapers, a conventional coin acceptor mechanism 26 which forms no part of this invention, an operating handle 28 to move the newspaper gripping and feeding mechanism as will be later described and a protected access slot 30 where the vended newspaper can be reached by the purchaser and removed.

The housing is comprised of a front wall 32, left side wall 34, right side wall 36, a rear wall 37 and a top wall 38. Supported within the housing is a newspaper stacking shelf 40 which has a main shelf portion 42 slanting at a slight upward slope from the right wall of the housing to the left wall. A rear portion 44 of the shelf has a slight downward slope toward the rear wall of the housing to provide a crown 46 on the shelf to facilitate the gripping and feeding of the top newspaper of the stack as will appear more fully herein below by accommodating the newspaper centerfold.

Figure 1:
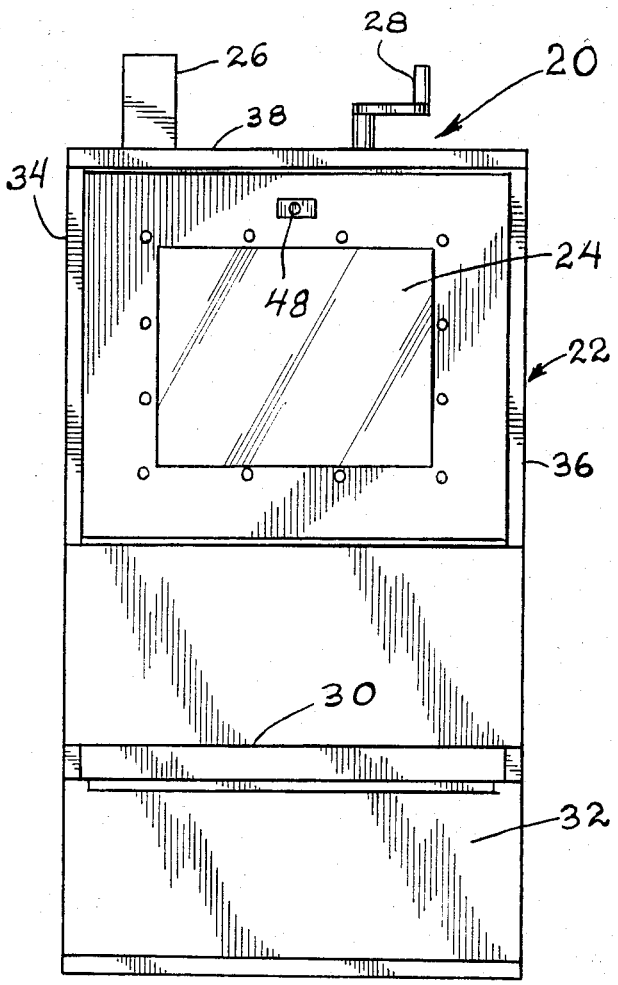
FIG. 1 is a view in front elevation of the vending machine.
Figure 2:
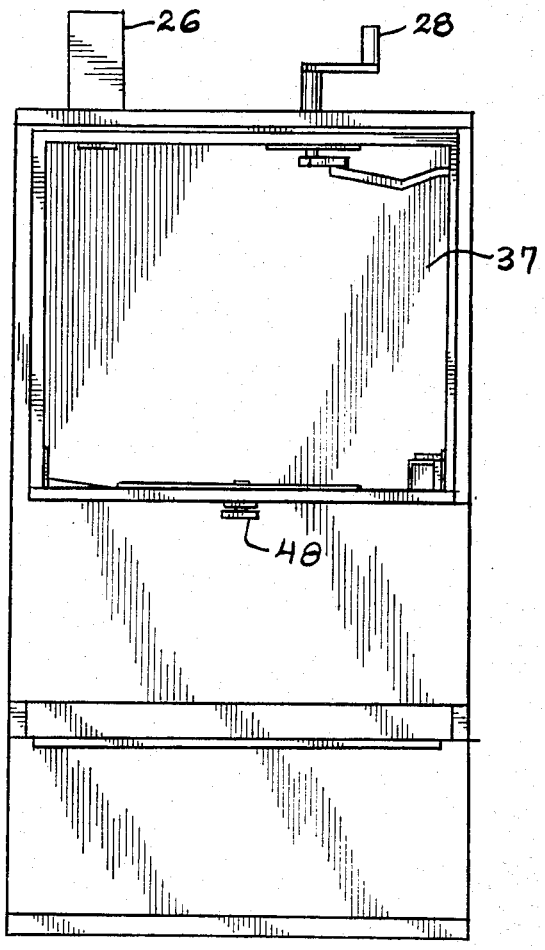
FIG. 2 is a view similar to FIG. 1 showing the paper loading door open.
Figure 4:
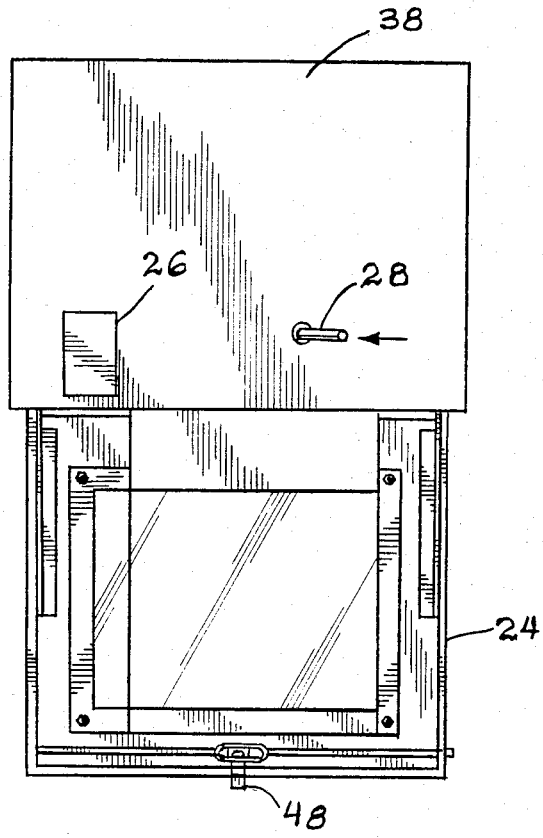
FIG. 4 is a top plan view of the machine.
Figure 3:
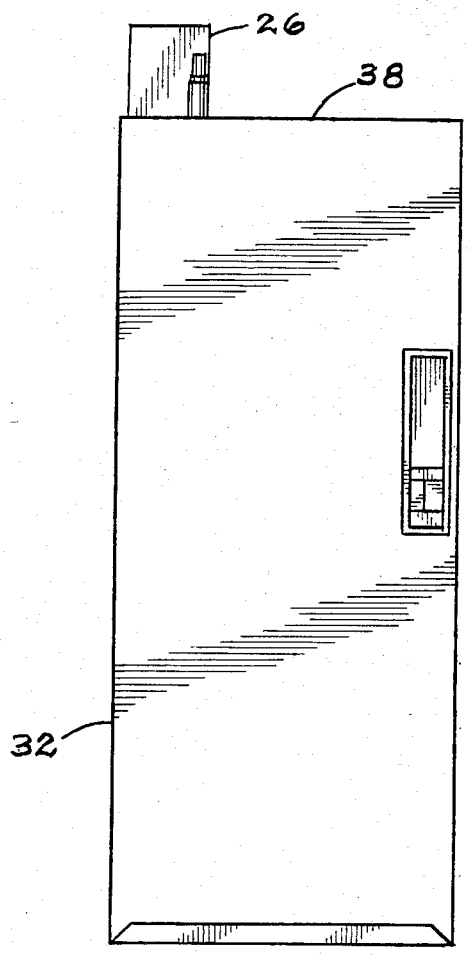
FIG. 3 is a view in right side elevation of the machine.

The newspaper charging door 24 as shown in FIGS. 1, 2 and 4 has a lock type handle 48 in order that it may be locked when the newspaper supply is not being replenished or removed. A glass front and single newspaper frame is provided in order to display the newspaper being vended.

A delivery chute 50 extends downwardly from the newspaper support shelf to the front wall below the front wall access slot to provide a path for the vended newspaper. The narrow width of the slot and substantial distance from the newspaper support shelf provides a security against theft of the newspaper from the support shelf as well as protection of the vended newspaper from the influence of the weather outside of the machine. The lip 52 of the front wall extending above the chute further provides a stop or rest for the newspaper until it is removed by the purchaser through the access slot.

The gripping and feeding member employed for feeding the top newspaper from a stack of newspapers is best shown in FIGS. 7 through 10 showing the sequence of operation and in FIGS. 11, 12 and 13 showing the construction in more detail. The gripping and feeding member employed is generally indicated by the reference numeral 54 and is comprised of a support plate 56 connected by an arm 58 to a square shaped vertical operating rod 60 which is adapted to be pivoted back and forth by the operation of the operating handle as will further appear. The arm 58 is vertically slidable on the operating arm and is lightly biased by a spring 62 to partially support the weight of the gripping and feeding mechanism to counterbalance the full weight upon the top newspaper in the stack on the support shelf.

The support plate 56 supports a pair of slightly flexible bowed serrated or toothed gripping and feeding elements 64 and 66. These are positioned one in front of the other as shown in FIGS. 12 and 13 to effect full gripping efficiency. The gripping and feeding elements are constructed of a stiff but slightly flexible material such as steel or the like such that when moved forwardly in the direction of the teeth in the feeding cycle they bend slightly to dig into the newspaper but with minimum penetration. In the retracting or rearward operation they brush lightly against the top of the next newspaper as they return to the start position. Teeth 67 are angled downward for "bite".

The operating handle mechanism for effecting movement of the operating rod 60 is best shown in FIGS. 5 through 10. Handle 28 is connected by vertical shaft 68 journalled in a support plate 70 to a toothed ratchet wheel 72. The ratchet wheel is rotatable in a unidrectional manner only through the engagement with a spring biased pawl 74.

The rotation of the handle and the shaft 68 effects a reciprocatory movement of the operating rod through a pitman type of linkage comprised of a first link 76 keyed to the handle shaft 68, a second link 78 pivotably connected at one end to link 76 and at its other end to a third link 80. The link 80 at its other end is keyed to the operating rod. The sequence of operation of the links is best shown in FIGS. 7 through 10. FIG. 7 shows the start of the vending operation, FIG. 8 shows a first stage of feeding operation as indicated by the direction of the arrow, FIG. 9 shows the completion of the feeding stage and FIG. 10 shows the retraction stage.

In order to prevent the operation of the handle and the feeding mechanism a locking mechanism is provided. This mechanism is best shown in FIGS. 5 through 10 and comprises a locking link 82 journalled in a support bracket 84 which cooperates with the coin acceptor mechanism to lock the handle until acceptance of the proper coinage. A coin acceptor operator member 86 is slidably received in a support bracket 88 and is adapted to be moved forwardly and rearwardly. It is locked by the coin mechanism, which as mentioned previously is conventional and forms no part of this invention, until acceptance of the coin when it is released. It is spring biased to rearward position in the bracket. An end 90 of the link 82 is received within a slot 92 in order that engagement may be effected.

The opposite end 94 of the lock link 82 is engageable by a semi-cam 96 supported on top of the ratchet wheel. A stop pin 98 connected to a stop or lock shoulder 100 of the cam prevent movement of the cam and the connected ratchet wheel when the end 90 of the lock link is locked by the coin acceptor operator member 86. When this member is freed the operating handle may be moved for the vending operation.

The coin acceptor operator member may also be blocked and the operating handle also by a stop mechanism when all the newspapers have been sold. This mechanism is best shown in FIGS. 5, 6, 7 and 11 comprises a sold out trip member 102 adapted to underly a stack of newspapers pivotably supported by a bracket 104 to the right side wall of the housing. It is connected by pivotable links 100 and 108 to stop member 110 pivotably connected at the upper right side of the housing at a bracket 112. The stop in the sold out position is pivotable to a position in advance of the coin acceptance operator blocking its movement as shown in FIG. 5. When not activated it is lowered to the unlocking position shown in FIG. 5.

USE

In use the newspaper vending machine is simply loaded or unloaded by unlocking the door handle 48 of the loading or charging door 24. In the loading operation a stack of newspapers 114 is placed on the support shelf 40 in such a manner that the centerfold is to the rear and the side fold of the newspapers is at the right side. The downward slope of the rear portion of the support shelf accomodate the additional bulk of the folded newspaper at the centerfold and prevents the buildup of uneven size of the stack that may occur with a number of newspapers and those having many pages such as the large city Sunday newspapers.

The machine is now ready to be operated. The vending operation is commenced by the usual insertion of the proper coinage in the conventional coin acceptor 26. Upon acceptance the coin acceptor operator 86 is unlocked for operation.

The dispensing operation is then commenced by turning the handle 28 slowly 360° clockwise from the start position indicated by the arrow in the top plan view of FIG. 4. The sequence of operation in the unlocking of the handle and the arc-like feeding and retracting movement is best shown in FIGS. 7, 8, 9 and 10.

In the first stage the rotation of the handle causes the cam 96 to move clockwise from the position shown in FIG. 7 to FIG. 8. The lock link 82 is pivoted to move the unlocked coin acceptor operator member 82 slightly to the front. In this same stage of operation the "pitman" linkage comprised of links 76, 78 and 80 connected to the handle shaft causes the operating rod 60 connected to the gripping and feeding member 54 to move counter-clockwise in an arc-like movement in the direction of the arrow on top of the top-most newspaper in the newspaper stack 114.

The gripping and feeding action on the top newspaper make use of the newspaper sturcture. The conventional folded newspaper has a sturdy centerfold as well as a stabilizing side fold. When these two folds are used together in conjunction with each other the paper can effectively be moved as a whole and single entity. In order for the two folds to work simultaneously the paper must be moved in a circular motion. Using the downwardly angled teeth in conjunction with the upward slope of the support shelf portion 42 causes the newspaper to be grabbed in the region of the centerfold and the newspaper to be pivoted forward with the side fold stabilizing the top newspaper as it is being moved.

FIG. 9 shows the location of the gripping and feeding member 54 at the completion of the dispensing cycle. At this stage and upon retraction to the position shown in FIG. 10 the top newspaper has been moved to the dispensing chute 50 where it comes to rest in a protected position against the lip or stop 52 adjacent the access slot 30. The purchaser may then remove the newspaper as desired.

Continued movement of the operating handle past the start position shown in FIG. 7 either by the purchaser who has just performed the vending operation or a new purchase can not be effected since the machine is locked in the retract cycle. The locking is effected as shown in FIGS. 9 and 10 as the end 94 of the lock link 82 rides off the cam 96. As this occurs the lock link no longer urges the coin acceptor member 86 forwardly and by its biasing action returns to its rearward position. As the handle is continued to be rotated toward the start postion the feed end 94 of the lock link comes into locking engagement with the lock pin 98 and shoulder stop 100 of the cam. The handle and its connected mechanism can be moved no further until the proper coinage can be inserted for another vending operation to free the coin acceptor operator member 86 and unlock the mechanism.

After the newspaper supply has been exhausted, further operation is effectively prevented by the activations of the sold out trip 102. The weight of the stack of newspapers placed on top of the sold out trip causes through the links 100 and 108 the stop member 110 to be moved to the downward position shown in FIG. 6 in the unlock position in front of the coin acceptor operator member 86. When the newspapers have been sold out the sold out trip is biased to move upwardly to the position shown in FIG. 5 where the stop 110 is moved in front of the coin acceptor member 86 to prevent its operation.

Various changes and modifications may be made within this invention as will be apparent to those skilled in the art. Such changes and modifications are within the scope and teaching of this invention as defined in the claims appended hereto.

What is claimed is:

1. A vending machine for newspapers and the like, said machine comprising a housing for the storage of said newspapers, a support in said housing for supporting said newspapers, feeding means for moving a newspaper off said support, said feeding means comprising a newspaper gripping and feeding member overlying a top surface of said newspaper and means for rotating said gripping member through a delivery cycle comprising a forward movement to engage the top surface and move said newspaper off said support to a delivery means in said housing and a rearward movement to the start of the next delivery cycle, said gripping and feeding member being provided with a serrated member and said forward movement being effected in the direction of said serrations, said serrations being in the form of a series of laterally extending teeth supported on a stiff base, said base being adapted to flex slightly to increase a grip-like bite into the top surface of a top-most newspaper engageable by said feeding and gripping member and said teeth being engageable with the top surface of the newspaper at a slightly downward angle pointed in the direction of forward movement, said base being slightly bowed downwardly and adapted to flex slightly toward a flattened position when the gripping and feeding member rests upon the newspaper.

2. The vending machine of claim 1 in which a pair of said serrated members are supported in tandem one behind the other by said gripping and feeding member.

3. A vending machine for newspapers and the like, said machine comprising a housing for the storage of said newspapers, a support in said housing for supporting said newspapers, feeding means for moving a newspaper off said support, said feeding means comprising a newspaper gripping and feeding member overlying a top surface of said of said newspaper and means for rotating said gripping member through a delivery cycle comprising a forward movement to engage the top surface and move said newspaper off said support to a delivery means in said housing and a rearward movement to the start of the next delivery cycle, said feeding means including handle means and linkage means connected thereto for driving said gripping and feeding member through said forward and rearward cycles, said handle means being rotatable through a 360° cycle to effect a complete feeding and retracting cycle and said linkage being connected to a handle shaft and comprising a pitman linkage to drive said gripping means in said forward feeding movement and said rearward retracting movement and looking means provided to lock the handle means until the acceptance of the proper coin by a coin acceptor mechanism, said means comprising a cam means connected to a handle shaft, said cam having a stop means engageable by a lock member moveable into engagment with said stop means and disengageable therefrom upon the acceptance of said proper coin by the coin acceptor mechanism and a coin acceptor operator member, said operator member being moveable from a locking position to an unlocking position and a locking link member engageable at one end by said operator member and at an opposite end by said cam means, said locking member being pivotably supported from said housing and upon the unlocking of said coin acceptor operator member being engageable by said cam means in driving relation to drive said operator member away from said locked position.

4. The vending machine of claim 3 in which a sold out means is provided, said means comprising a pivotably supported biased trip member engageable by a stack of newspaper restable upon said trip member and linkage means connecting said trip member to a sold out stop member moveable from an unlocked position out of engagement with said coin acceptor operator member when said trip member is engaged by said newspapers to a locking position engageable with said operator member to stop it from movement.

* * * * *